US009385499B2

(12) United States Patent
Guo

(10) Patent No.: US 9,385,499 B2
(45) Date of Patent: Jul. 5, 2016

(54) ELECTRICAL CONNECTOR PREVENTING SHORTING BETWEEN CONTACTS AND REINFORCING PLATE THEREOF

(71) Applicant: FOXCONN INTERCONNECT TECHNOLOGY LIMITED, Grand Cayman (KY)

(72) Inventor: Jing-Jie Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/594,474

(22) Filed: Jan. 12, 2015

(65) Prior Publication Data

US 2015/0200506 A1 Jul. 16, 2015

(30) Foreign Application Priority Data

Jan. 15, 2014 (CN) ..... 2014 1 0017235
Jan. 15, 2014 (CN) ..... 2014 1 0017411

(51) Int. Cl.

| | |
|---|---|
| ***H01R 43/24*** | (2006.01) |
| ***H01R 13/405*** | (2006.01) |
| ***H01R 24/60*** | (2011.01) |
| *H01R 13/6581* | (2011.01) |

(52) U.S. Cl.

CPC ..... *H01R 43/24* (2013.01); *H01R 13/405* (2013.01); *H01R 24/60* (2013.01); *H01R 13/6581* (2013.01)

(58) Field of Classification Search

CPC ..... H01R 23/7005; H01R 43/24
USPC ..... 439/607.4, 607.66, 607.57, 607.58, 736
See application file for complete search history.

(56) References Cited

U.S. PATENT DOCUMENTS

| | | | | |
|---|---|---|---|---|
| 7,682,199 | B2 | 3/2010 | Ahn et al. | |
| 7,922,535 | B1 * | 4/2011 | Jiang | H01R 13/5205 439/271 |
| 8,083,549 | B1 * | 12/2011 | Chiang | H01R 13/6581 439/607.55 |
| 8,109,795 | B2 * | 2/2012 | Lin | H01R 13/6461 439/660 |
| 8,657,633 | B2 | 2/2014 | Shindo et al. | |
| 8,662,928 | B1 * | 3/2014 | Xie | H01R 13/6594 439/607.35 |
| 2014/0187105 | A1 * | 7/2014 | Zhao | H01R 12/707 439/733.1 |

FOREIGN PATENT DOCUMENTS

| | | |
|---|---|---|
| CN | 201904481 | 7/2011 |
| JP | 4875130 | 12/2011 |

OTHER PUBLICATIONS

English Translation of JP4875130.*

* cited by examiner

*Primary Examiner* — Tho D Ta
*Assistant Examiner* — Marcus Harcum
(74) *Attorney, Agent, or Firm* — Ming Chieh Chang; Wei Te Chung

(57) ABSTRACT

An electrical connector (100) includes a metal shield (1) defining a receiving space (10), a number of contacts (2) received in the metal shield, an insulative body (3) molding over the metal shield and having a tongue portion (31) extending into the receiving space for retaining the contacts, and a reinforcing plate (4) attaching to the tongue portion for reinforcing the tongue portion. The insulative body has a number of slits (311) at the front side of the tongue portion and a number of slots (332) at a rear side of the tongue portion for respectively receiving a mold during molding. The reinforcing plate and the contacts are exposed to both the slits and the slots along opposite, vertical directions to make sure that the inserted molds bear against both the contacts and the reinforcing plate.

17 Claims, 5 Drawing Sheets

ELECTRICAL CONNECTOR PREVENTING SHORTING BETWEEN CONTACTS AND REINFORCING PLATE THEREOF

BACKGROUND OF THE INVENTION

1. Field of the Invention

The present invention relates generally to an electrical connector, and more particularly to an electrical connector preventing shorting between contacts and reinforcing plate thereof.

2. Description of Related Arts

Japan Pat. No. 4875130 issued on Dec. 2, 2011 discloses an electrical connector comprising a metal shield with a receiving space, a plurality of contacts received in the receiving space of the metal shield, and an insulative body molding over the metal shield and retaining the contacts. The metal shield together with the contacts is insert molded in one-shot via the insulative body. The insulative body forms an insulative cover adhering to an outside surface of the metal shield and a tongue portion extending forwardly into the receiving space for supporting the contacts.

U.S. Pat. No. 7,682,199 issued to Ahn et al. on Mar. 23, 2010 discloses another electrical connector comprising an insulative body having a tongue portion and a reinforcing plate positioned below the tongue portion for reinforcing the tongue portion. The electrical connector comprises a plurality of contacts extending to the tongue portion for engaging with a mating plug. The contacts and the reinforcing plate are compactly positioned on the tongue portion. The contacts and the reinforcing plate are so closely spaced that mis-handling during molding may result in shorting between the contacts and the reinforcing plate.

U.S. Pat. No. 8,657,633 issued to Shindo et al. on Feb. 25, 2014 discloses that a mold-in shell and a plurality of contacts are formed integrally with an insulative housing by insert molding process. Generally, a molding die has projecting portions so as to arrange a metal member in a molding object. During molding the housing, the projecting portions are brought into contact with the contacts and the mold-in shell so as to arrange the contact and the mold-in shell at appropriate positions. The projecting portions of the molding-die leave the housing with a plurality of first and second holes. In detail, the molding-die is brought into contact with the contacts and then the first holes are formed; the molding-die is brought into contact with the mold-in shell and then the second hole is formed.

An electrical connector preventing shorting between contacts and reinforcing plate thereof is desired.

SUMMARY OF THE INVENTION

Accordingly, an object of the present invention is to provide an electrical connector preventing shorting between contacts and reinforcing plate thereof.

To achieve the above object, an electrical connector includes a metal shield defining a receiving space, a number of contacts received in the metal shield, an insulative body molding over the metal shield and having a tongue portion extending into the receiving space for retaining the contacts, and a reinforcing plate attaching to the tongue portion for reinforcing the tongue portion. The insulative body has a number of slits at the front side of the tongue portion and a plurality of slots at a rear side of the tongue portion for respectively receiving a mold during molding. The reinforcing plate and the contacts are exposed to both the slits and the slots along opposite, vertical directions to make sure that the inserted molds bear against both the contacts and the reinforcing plate.

Other objects, advantages and novel features of the invention will become more apparent from the following detailed description when taken in conjunction with the accompanying drawings.

DETAILED DESCRIPTION OF THE PREFERRED EMBODIMENT

Figure 1:
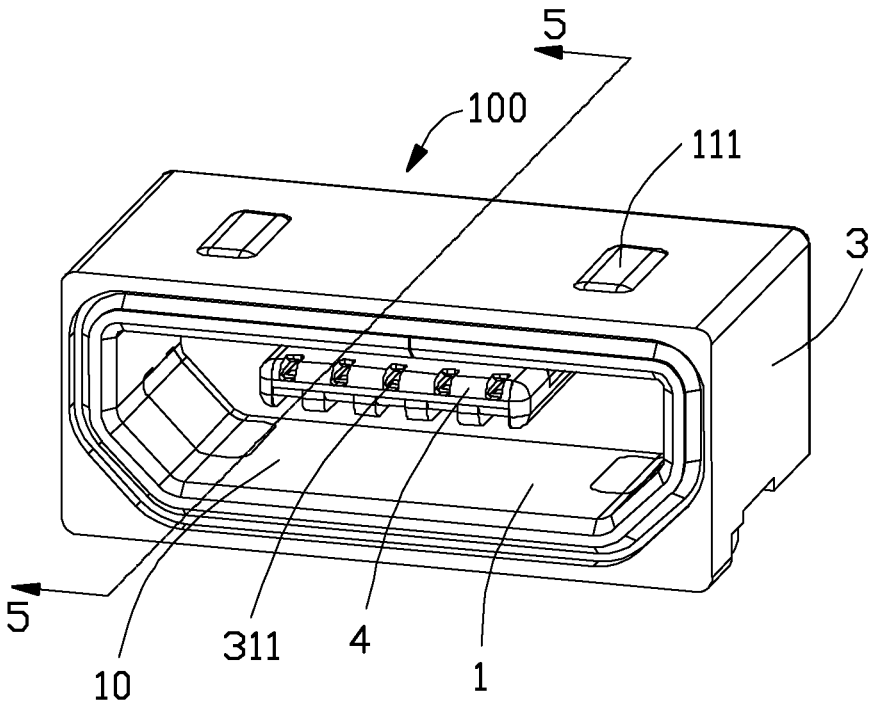
FIG. 1 is a perspective, assembled view of an electrical connector constructed in accordance with the present invention.
Figure 2:
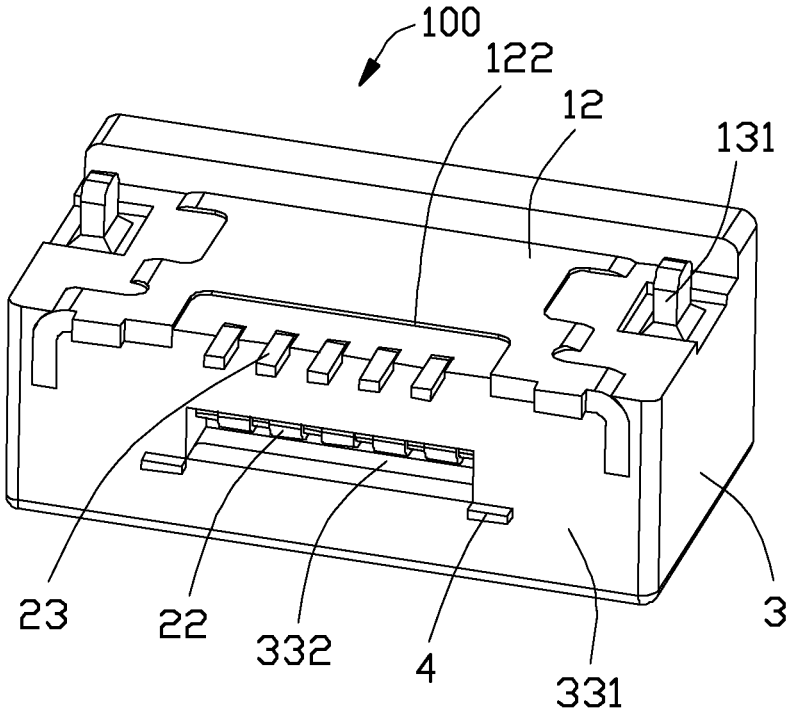
FIG. 2 is similar to FIG. 1, but taken from a different view.
Figure 3:
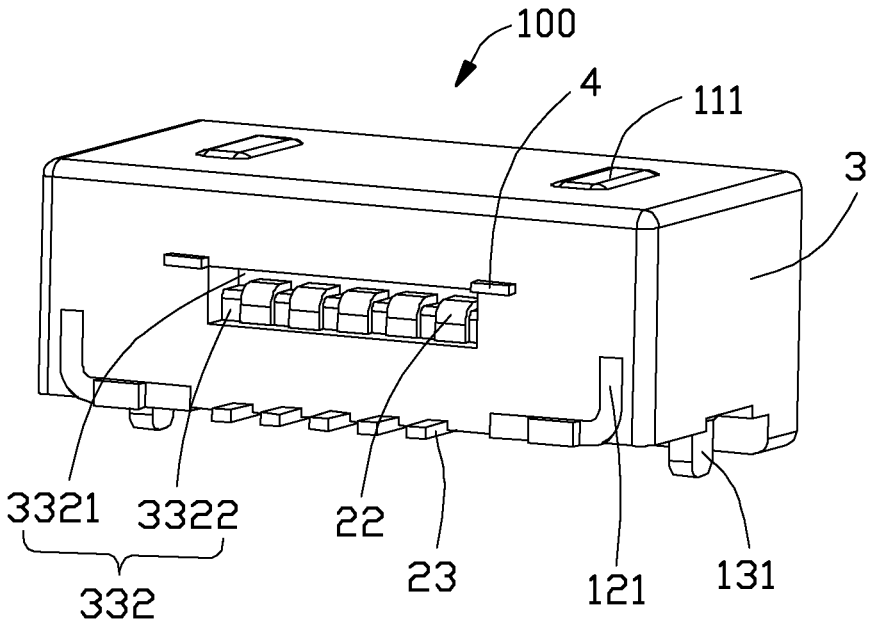
FIG. 3 is similar to FIG. 1 and FIG. 2, but taken from another different view.

Reference will now be made in detail to the preferred embodiment of the present invention.

Referring to FIGS. 1-5, an electrical connector 100 of the present invention, comprises a metal shield 1 defining a receiving space 10, a plurality of contacts 2 received in the metal shield 1, an insulative body 3 molding over the metal shield 1 and having a tongue portion 31 extending into the receiving space 10 for retaining the contacts 2, and a reinforcing plate 4 attaching to the tongue portion 31 for reinforcing the tongue portion 31.

Referring to FIGS. 1-4, the metal shield 1 is stamped from a metal piece. The metal shield 1 comprises a top wall 11, a bottom wall 12 opposite to the top wall 11, and a pair of sidewalls 13 connecting between the top wall 11 and the bottom wall 12. The receiving space 10 is substantially defined by the top wall 11, the bottom wall 12, and the sidewalls 13. The top wall 11 has a jointing slit 123. The top wall 11 forms a pair of protrusions 111 for engaging with a mating connector (not shown) when the mating connector is inserted in the receiving space 10 along a front-and-rear direction. The metal shield 1 comprises a pair of board locks 131 downwardly extending from jointing parts of the bottom wall 12 and the sidewalls 13 for securing with a printed circuit board (not shown). The metal shield 1 comprises a pair of fixing legs 121 extending upwardly from the sidewalls 13. The fixing legs 121 are retained in the insulative body 3 for reinforcing the metal shield 1 in the insulative body 3. The bottom wall 12 defines a rectangular cutout 122 for giving up the contacts 2.

Figure 4:
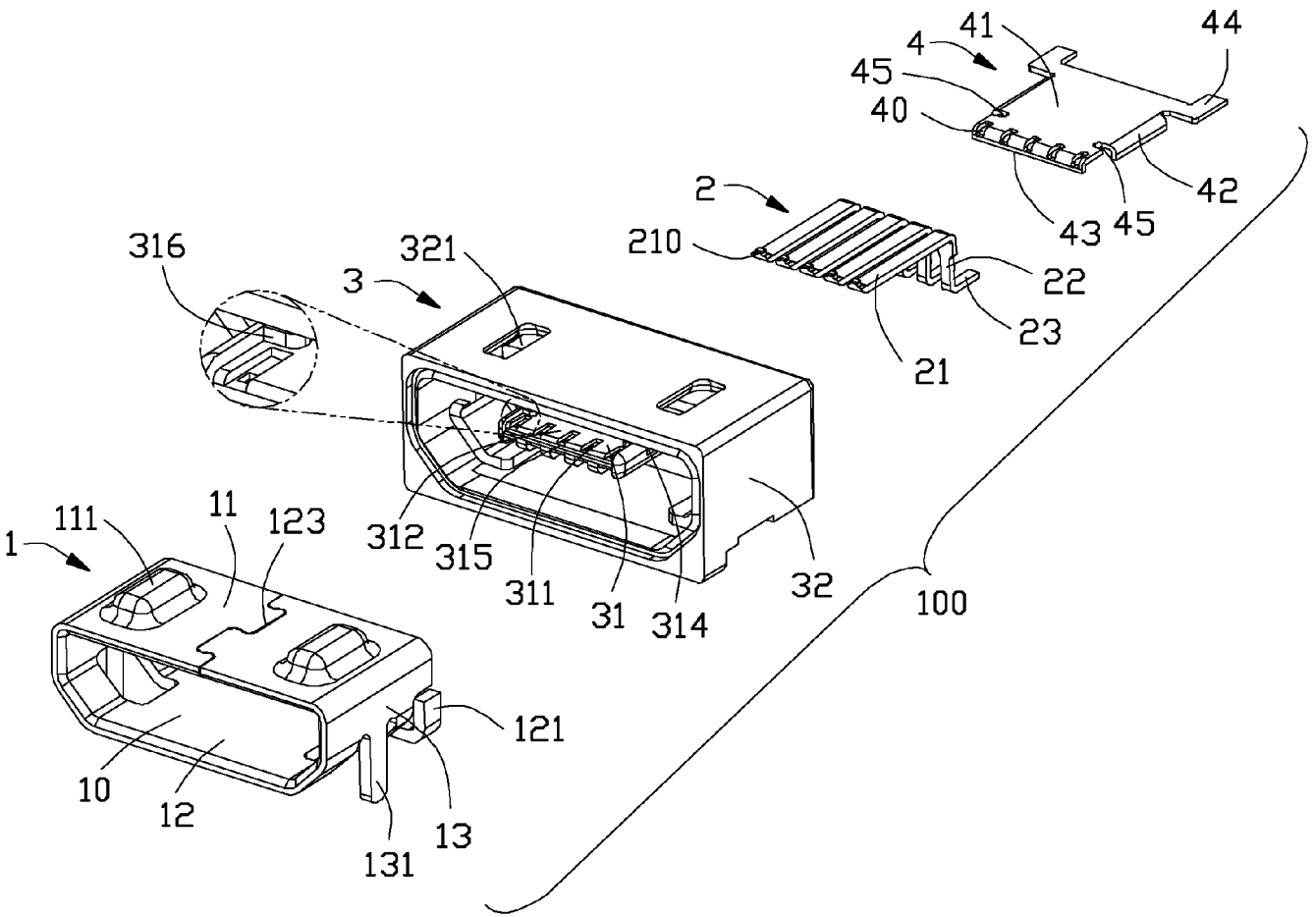
FIG. 4 is a perspective, exploded view of the electrical connector of FIG. 1.
Figure 5:
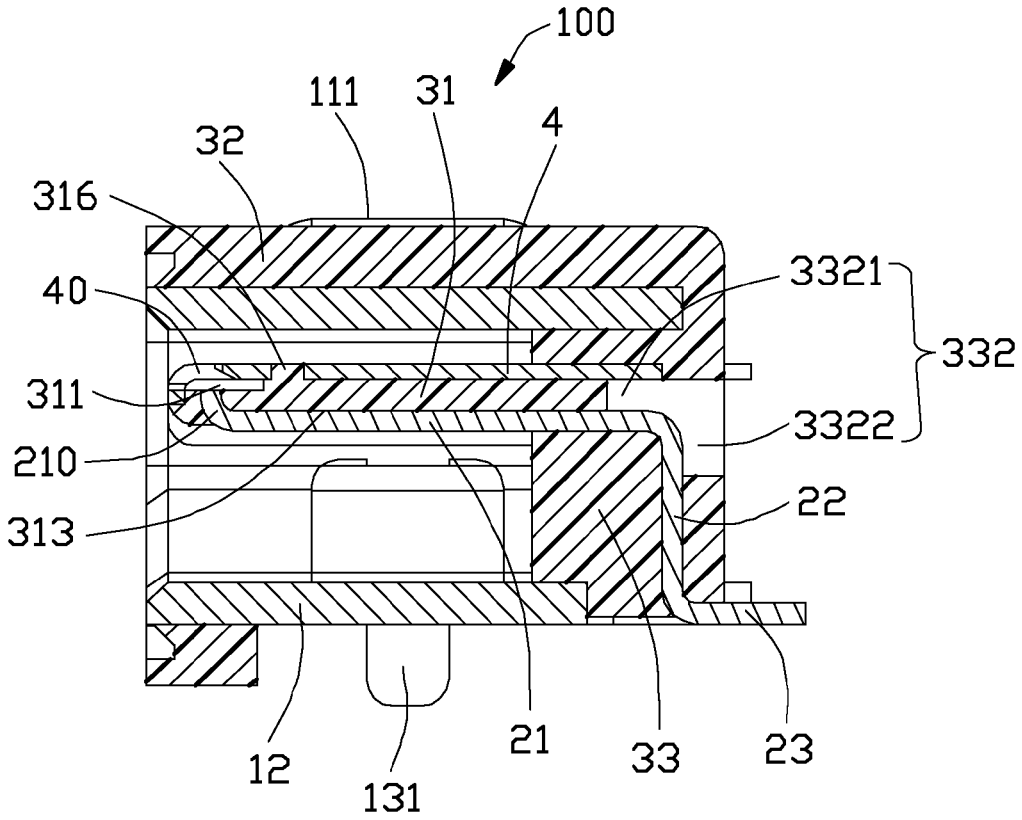
FIG. 5 is a cross-sectional view of FIG. 1 when taken along line 5-5.

Referring to FIGS. 4 and 5, the contacts 2 are positioned along a left-and-right direction perpendicular to the front-and-rear direction. The contacts 2 comprise a plurality of contacting portions 21 partly received in the tongue portion 31 and partly extending below the tongue portion 31 to be exposed in the receiving space 10 for engaging with the mating connector, a plurality of retaining portions 22 extending backwardly and vertically from the contacting portions 21, and a plurality of soldering portions 23 extending backwardly from the retaining portions 22 and outside of the insulative body 1 for soldering on the printed circuit board. Each contacting portion 21 has a leading portion 210 tilting up forwardly. A width of the leading portion 210 is smaller than other portions of the contacting portion 21 for preventing the leading portion 210 from getting in touch with the reinforcing plate 4. The contacting portions 21 are located on the tongue portion 31 at a horizontal plane which is different from the reinforcing plate 4.

Referring to FIGS. 4 and 5, the insulative body 3 is overmolded with the metal shield 1, the contacts 2, and the reinforcing plate 4 for integration. The insulative body 3 comprises the tongue portion 31, an insulative cover 32 molding over the metal shield 1, and a rear portion 33 connecting the tongue portion 31 and the insulative cover 32 for sealing the receiving space 10 at the rear part thereof. The tongue portion 31 extends forwardly from the rear portion 33 into the receiving space 10. The insulative cover 32 partly shields the metal shield 3. In detail, the insulative cover 32 covers the top wall 11 and the sidewalls 13 except that the protrusions 111 extend out of the insulative cover 32. The insulative cover 32 defines a pair of apertures 321 correspondingly receiving the protrusions 111. The insulative cover 32 merely covers a plurality of interspaces of the bottom wall 12 which communicate the receiving space 10 with exterior. The special design of the insulative cover 32 makes sure that the electrical connector 100 of the present invention has a good waterproof performance and also has a small size for space saving purpose. The rear portion 33 has a rear surface 331 concaved towards the receiving room 10 to be a slot 332 for inserting some molds (not shown). The slot 332 comprises a horizontal slot 3321 to be sandwiched between the contacts 2 and the reinforcing plate 4 and a vertical slot 3322 communicating with and perpendicular to the horizontal slot 3321. The horizontal slot 3321 extends forwardly to the tongue portion 31 but does not extend into the receiving space 10 via a multiple of plastic material of the rear portion 33 spaces the horizontal slot 3321 away from the receiving space 10 along the front-and-rear direction for waterproof purpose. Both the contacting portions 21 of the contacts 2 and the reinforcing plate 4 are exposed to the horizontal slots 3321 such that when a first mold (not shown) is inserted in the horizontal slots 3321, the first mold bears against both the contacts 2 and the reinforcing plate 4 for preventing shorting generated between the contacts 2 and the reinforcing plate 4. The vertical slots 3322 are positioned behind the retaining portions 22 of the contacts 2. A second mold (not shown) is inserted in the vertical slots 3322. The inserted second mold bears against the contacts 2 for preventing the contacts 2 from being withdrawn along the front-and-rear direction.

The tongue portion 31 comprises an upper face 312, a lower face 313, a pair of lateral faces 314, and a front face 315 connecting between the upper face 312, the lower face 313, and the lateral faces 314. The reinforcing plate 4 comprises a main plate 41 overlapping the upper face 312 of the tongue portion 31, a pair of side plates 42 laterally bending from the upper face 312 and overlapping the lateral faces 314 of the tongue portion 31, a front plate 43 forwardly bending from the front face 315 and overlapping the front face 315 of the tongue portion 31, and a fixing plate 44 extending backwardly from the main plate 41 and retaining in the rear portion 33 of the insulative body 3. The reinforcing plate 4 defines a plurality of notches 40 at a jointing part of the front plate 43 and the main plate 41 for inserting a third mold (not shown). Numeral of the notches 40 is equal to that of the contacts 2.

Referring to FIGS. 1, 4, and 5, the tongue portion 31 of the insulative body 3 defines a plurality of slits 311 at a jointing part of the upper face 312 and the front face 315 thereof. The slits 311 are correspondingly directed to and communicated with the notches 40. A length of each slit 311 is larger than that of each notch 40 along the front-and-rear direction. Each slit 311 is located above the leading portion 210 along a vertical direction perpendicular to the front-and-rear direction and the left-and-right direction. The leading portion 210 is exposed to the slit 311 without extending in the slit 311. The third mold bears against both the contacts 2 and the reinforcing plate 4 for preventing shorting generated between the contacts 2 and the reinforcing plate 4, too. It is noted that the reinforcing plate 4 forms a pair of recessions 45 in two opposite lateral sides so as to form the corresponding protrusions 316 on the tongue portion 31 received therein after the one short insert-molding process.

The electrical connector 100 of the present invention has a plurality of notches 40 and slits 311 at the front side thereof and a plurality of slots 332 at a rear side thereof for respectively receiving a mold, and therefore, the contacts 2 and the reinforcing plate 4 are prevented from connecting with each other and then, shorting is prevented thereby.

The main feature of the invention is to provide a method of making the whole connector via only one shot insert-molding process operated along a front-to-back direction to simultaneously have the metal shield 1, the contacts 2, the insulative body 3 and the reinforcing plate 4 assembled and joined together wherein the tongue portion 31 of the insulative body 3 extends forwardly within a receiving space 10 defined by the metal shield 1, the reinforcing plate 4 and the contacts 2 are respectively exposed upon two opposite surfaces of the tongue portion 31, and the insulative body 3 further covers a top wall of the metal shield 1 while essentially exposing the bottom wall of the metal shield 1. Another feature is to provide the recessed structure around the front edge of the tongue portion 31, i.e., the notch 40 in the reinforcing plate 4 and/or the slit 311 of the insulative body 3, via the corresponding mold, around a front region of the metal shield 1 and a front end region of each contact 1 so as to avoid potential shorting therebetween during the one shot insert-molding process. Understandably, such recessed structure, i.e., the notch and/or slit may be filled with other insulative material after the one shot insert-molding process so as to protectively cover the front end of the contact 1 without potential risk of any external conductive tiny part improperly entering in the notch and/or slit to electrically connect and make shorting between the front end region of the contact 1 and the edge area of the shield 1 around the notch.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a metal shield defining a receiving space;

a plurality of contacts received in the metal shield;

an insulative body molding over the metal shield and having a tongue portion extending into the receiving space for retaining the contacts; and a reinforcing plate attaching to the tongue portion for reinforcing the tongue portion;

wherein the insulative body has a plurality of slits at a front side of the tongue portion and a plurality of slots at a rear side of the tongue portion for respectively receiving a mold during molding, the reinforcing plate and the contacts are exposed to both the slits and the slots along opposite, vertical directions for the molds to bear against both the contacts and the reinforcing plate at both the front and rear ends of the tongue portion;

wherein the contacts are spaced away from the reinforcing plate via the slits and the slots, and both the slits and slots are left by removing the molds; and wherein the reinforcing plate defines a plurality of notches correspondingly directed to and communicated with the slits.

2. The electrical connector as claimed in claim 1, wherein the contacts comprise a plurality of contacting portions partly received in the tongue portion and partly extending below the tongue portion to be exposed in the receiving space for engaging with a mating connector, a plurality of retaining portions extending backwardly and vertically from the contacting portions, and a plurality of soldering portions extending backwardly from the retaining portions and outside of the insulative body for soldering on a printed circuit board, each contacting portion has a leading portion tilting up forwardly, and each slit is located above the leading portion along the vertical direction.

3. The electrical connector as claimed in claim 2, wherein the leading portion is exposed to the slit without extending in the slit.

4. The electrical connector as claimed in claim 2, wherein a length of each slit is larger than that of each notch along a front-and-rear direction perpendicular to the vertical direction.

5. The electrical connector as claimed in claim 2, wherein each slot comprises a horizontal slot sandwiched between a corresponding contact and the reinforcing plate and a vertical slot communicating with and perpendicular to the horizontal slot, and wherein the vertical slots are positioned behind the retaining portions of the contacts.

6. The electrical connector as claimed in claim 5, wherein the tongue portion is sandwiched between the contacts and the reinforcing plate along the vertical direction and between the leading portion and the horizontal slot along a front-and-rear direction perpendicular to the vertical direction.

7. The electrical connector as claimed in claim 5, wherein the horizontal slot extends forwardly to the tongue portion without extending into the receiving space, and a part of the insulative body spaces the horizontal slot apart from the receiving space along a front-and-rear direction perpendicular to the vertical direction.

8. The electrical connector as claimed in claim 7, wherein the contacting portions of the contacts and the reinforcing plate are exposed to the horizontal slots.

9. A method of making an electrical connector via a one-shot insert-molding process, comprising steps of:

providing a metal shield having opposite top and bottom walls in a vertical direction, and opposite two side walls in a transverse direction perpendicular to said front-to-back direction to commonly define a receiving space therein to forwardly communicate with an exterior in the front-to-back direction;

providing a plurality of contacts side by side arranged with one another along said transverse direction, each of said contacts extending along a front-to-back direction perpendicular to both said vertical direction and said transverse direction with a front end of a corresponding horizontal contacting section which is located in the receiving space;

providing a metallic reinforcing plate in the receiving space and spaced from the contacting sections of the contacts in the vertical direction; and applying an insulative body to a combination of said metal shield, said contacts and said reinforcing plate via a one shot insert-molding process to form a tongue portion thereof extending along the front to back direction and having in the vertical direction two opposite surfaces on which the contacting sections and the reinforcing plate are seated respectively, and form an insulative cover thereof to intimately contact and cover the top wall of the metal shield in the vertical direction; wherein said one shot insert-molding process is operated by molds moveable along the front-to-back direction; and after said one-shot insert-molding process, a plurality of recessed structures are formed around a front edge of the tongue portion and in front of corresponding contacting section of the corresponding contacts, respectively, along said front-to-back direction, and each of said recesses is occupied by a mold and directly communicatively confronts a front end region of the contacting section of the corresponding contact and a front region of the reinforcing plate so as to avoid shorting between said front end region of the contacting section of the corresponding contact and said front region of the reinforcing plate during said one shot insert-molding process.

10. The method as claimed in claim 9, wherein the bottom wall is exposed to said exterior in the vertical direction while a vertical section of each of said contacts is protectively hidden behind the insulative body.

11. The method as claimed in claim 9, wherein the metal shield is unitarily formed with a pair of downwardly mounting legs and a pair of fixing legs located by two sides of tail sections of the contacts in the transverse direction.

12. The method as claimed in claim 9, wherein each of said recesses includes joined slit and notch, and said slit is formed within the insulative body while said notch is formed within the reinforcing plate.

13. The method as claimed in claim 9, wherein the reinforcing plate forms a pair of recessions to receive a pair of protrusions formed on the tongue portion for restriction of relative movement between the reinforcing plate and the tongue portion in the front-to-back direction and the transverse direction.

14. An electrical connector comprising:

a metal shield including opposite top and bottom walls in a vertical direction and opposite two lateral side walls in a transverse direction perpendicular to said vertical direction to commonly define a receiving space therein to communicate with an exterior in a front-to-back direction perpendicular to both said vertical direction and said transverse direction;

an insulative body joined upon the metal shield via a one shot insert-molding process to intimately cover the top wall, said insulative body further including a tongue portion disclosed within the receiving space and extending forwardly along said front-to-back direction and defining opposite two surfaces in said vertical direction;

a metallic reinforcing plate joined with said insulative body via said one shot insert-molding process and intimately seated upon one surface of the tongue portion;

a plurality of contacts joined with said insulative body via said one shot insert-molding process and intimately seated upon the other surface of the tongue portion; and a plurality of recessed structures being formed in a front end region of the tongue portion to communicate with both a front end of each contact and a front region of the reinforcing plate once the one shot insert-molding process is finished so as to avoid shorting between the front end of the contact and the front region of the reinforcing plate during the one shot insert molding process.

15. The electrical connector as claimed in claim 14, wherein said recessed structures are configured to be occupied by corresponding molds during said one shot insert-molding process and said molds are operated along the front-to-back direction.

16. The electrical connector as claimed in claim 14, wherein each of said recessed structures includes joined notch and slit, said notch being formed within the front region of the reinforcing plate and said slit formed in the tongue portion.

17. The electrical connector as claimed in claim 16, wherein a front edge of the reinforcing plate is located in front of said notches in the front-to-back direction.

* * * * *